United States Patent [19]

Pennington

[11] Patent Number: 4,504,087

[45] Date of Patent: Mar. 12, 1985

[54] LEVER ATTACHMENT FOR A ROTARY DOOR KNOB

[76] Inventor: Alfred C. Pennington, G-13116 North Belsay Rd., Millington, Mich. 48746

[21] Appl. No.: 283,895

[22] Filed: Jul. 16, 1981

Related U.S. Application Data

[63] Continuation-in-part of Ser. No. 163,945, Jun. 30, 1980, abandoned.

[51] Int. Cl.[3] ..... E05C 21/00

[52] U.S. Cl. ..... 292/347; 292/336.3; 292/DIG. 2; 81/64

[58] Field of Search ..... 292/1, 336.3, 347, DIG. 2; 81/64, 3.43

[56] References Cited

U.S. PATENT DOCUMENTS

| | | | |
|---|---|---|---|
| 276,064 | 4/1883 | Morse | 81/64 |
| 838,086 | 12/1906 | Crouse | 81/64 |
| 1,788,507 | 1/1931 | Burgin | 81/64 |
| 3,380,267 | 4/1968 | Winchester | 292/307 X |
| 3,575,453 | 4/1971 | Hohl | 292/336.3 |
| 3,827,739 | 8/1974 | Overholser | 292/DIG. 2 X |
| 4,007,650 | 2/1977 | Wellman | 81/64 |
| 4,285,536 | 8/1981 | McCoy et al. | 292/DIG. 2 X |

*Primary Examiner*—Richard E. Moore

*Attorney, Agent, or Firm*—Learman & McCulloch

[57] ABSTRACT

A lever attachment for a rotary door knob comprises an arcuate collar adapted to embrace the knob, the collar terminating at its opposite ends in arms and being formed on an arc such that the arms have a tendency to diverge. The collar is formed of material sufficiently resilient to enable the arms to be moved into engagement with one another, thereby causing radial contraction of the collar and enabling the latter to grip the knob. The arms are releasably maintained in engagement by any one of a number of different kinds of latches.

15 Claims, 13 Drawing Figures

LEVER ATTACHMENT FOR A ROTARY DOOR KNOB

RELATED APPLICATION

This application is a continuation-in-part of application Ser. No. 163,945, filed June 30, 1980, now abandoned.

BACKGROUND OF THE INVENTION

It is common practice to provide interior and exterior doors of buildings with knobs which must be rotated to effect opening of the doors. Rotation of a door knob is not a simple undertaking for many persons, such as those afflicted with arthritis or whose hands or arms are otherwise handicapped. A rockable lever is more easily manipulated by such persons, but by the time the handicap of some persons mainfests itself the doors of the building occupied by such persons may already be fitted with rotary knobs. The expense of replacing rotary knobs with rockable levers may be beyond the means of many persons who could desire such replacement.

The desirability of converting rotary knobs to rockable levers by the attachment of a lever to a rotary knob has been recognized heretofore. Typical of conversion devices heretofore proposed are those disclosed in Sutter U.S. Pat. Nos. 2,756,088 and 2,801,122; Hohl U.S. Pat. No. 3,575,453; and Overholser U.S. Pat. No. 3,827,739. Although the constructions disclosed in these patents enable a rotary knob to be converted to a rockable lever, each of such constructions requires the use of one or more tools to effect the conversion. Quite often, the person who desires to make the conversion is incapable of using the necessary tools, thereby requiring the assistance of some other person.

Another objection to conversion devices of the kind heretofore proposed is that, when such devices are installed, some or all of the mounting means is visible, thereby detracting from the appearance of the door knob and the door on which it is mounted.

An object of the present invention is to provide a lever attachment adapted to be fitted to a rotary door knob and which requires the use of no tools in mounting the attachment on the knob.

Another object of the invention is to provide an attachment of the kind referred to and wherein the mounting means is invisible or disguised.

SUMMARY OF THE INVENTION

A lever attachment for a rotary door knob comprises an arcuate collar terminating at its opposite ends in a pair of arms which diverge when the attachment is conditioned for mounting on the door knob. The collar is formed from a material having a resiliency such that the radius of the collar may be reduced to effect movement of the arms toward and into engagement with one another. The radius of the collar, when reduced, is such that the collar will embrace and grip tightly a rotary knob, and the resilience of the collar material will tend to separate the arms. Latch means is provided for releasably latching the arms in engagement with one another, and the tendency of the collar to expand radially maintains the latch means snugly in latching condition. The collar thus will be retained in snug, frictional engagement with the knob so as to enable rotation of the knob in response to rocking of the lever attachment.

DESCRIPTION OF THE DRAWINGS

Attachments constructed in accordance with the invention are disclosed in the following description and in the accompanying drawings, wherein.

Figures 1, 2, 3, 4, 5, 6, 7, 8, 9:
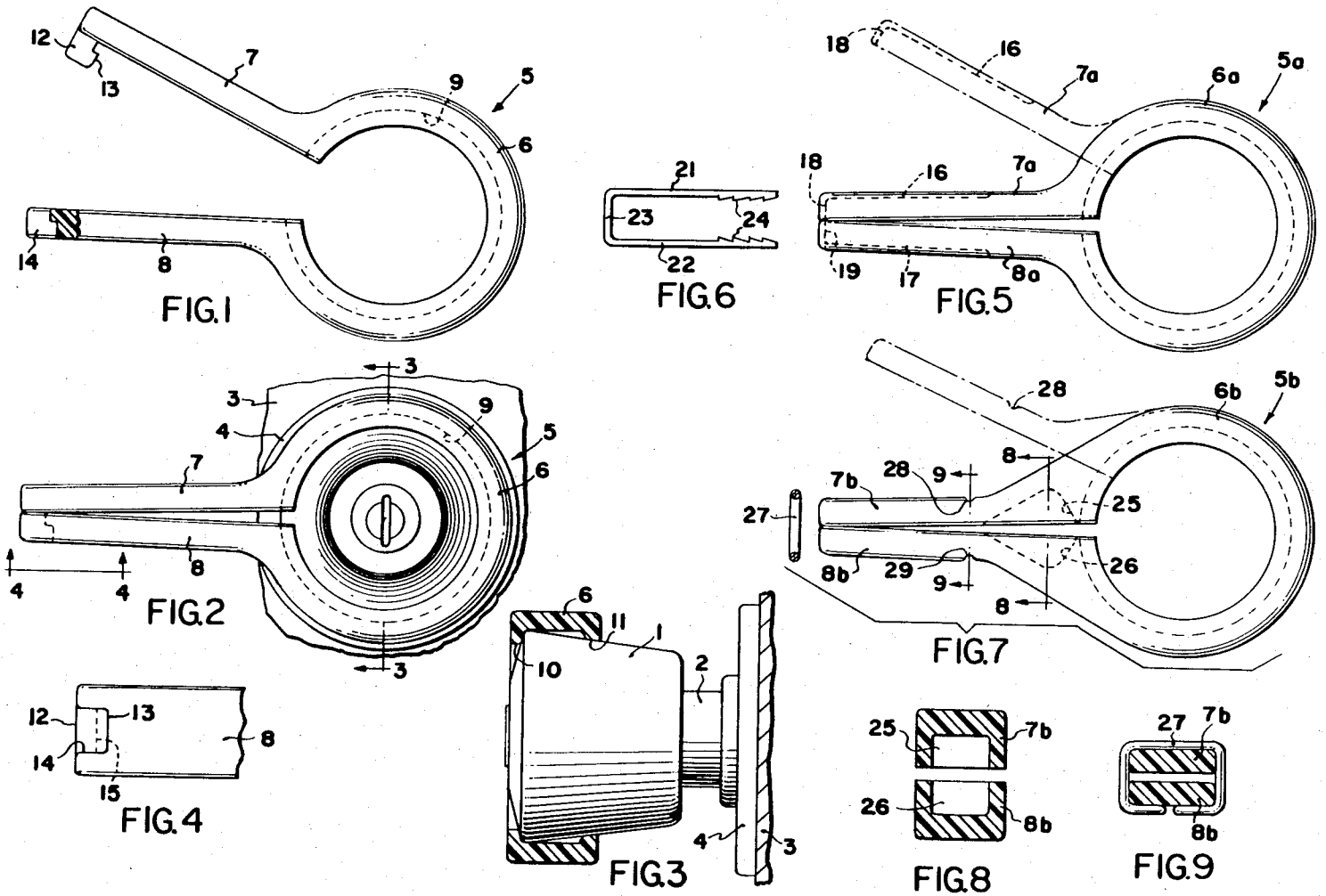
FIG. 1 is an elevational view of a lever attachment according to one embodiment of the invention and prior to assembly with a door knob.
FIG. 2 is an elevational view of the attachment applied to a rotary knob.
FIG. 3 is a sectional view taken on the line 3—3 of FIG. 2.
FIG. 4 is a fragmentary, plan view of a portion of the apparatus as viewed in the direction of the arrows 4—4 of FIG. 2.
FIG. 5 is a view similar to FIG. 1, but illustrating another embodiment.
FIG. 6 is an elevational view of a modified form of latch adapted for use with the attachment of FIG. 5.
FIG. 7 is a view similar to FIG. 2, but illustrating another embodiment of the attachment.
FIGS. 8 and 9 are sectional views on the lines 8—8 and 9—9, respectively, of FIG. 7.
Figure 10:
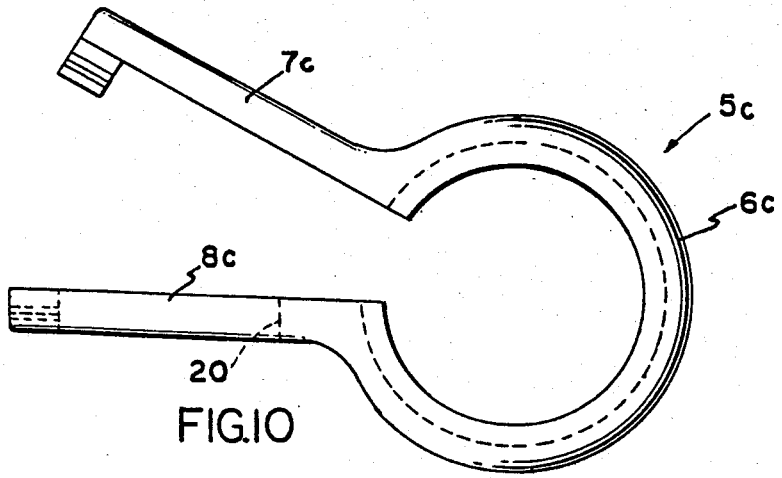
FIG. 10 is a view similar to FIG. 1, but illustrating a modified embodiment.

An attachment constructed in accordance with all embodiments of the invention is adapted for used in conjunction with a rotary door knob 1 that is rotatably mounted on a sleeve 2 mounted on a door 3 via a garnish ring 4. A rotary stem (not shown) extends through the sleeve 2 and is connected at one end to the knob 4 and at its other end to a bolt operating mechanism (not shown) as is conventional. To effect movement of the bolt between its retracted and projected positions, the knob 1 must be rotated.

An attachment according to the embodiment of the invention disclosed in FIGS. 1–4 is designated generally by the reference character 5 and comprises a one-piece, molded member having an arcuate collar 6 terminating at its opposite ends in a pair of arms 7 and 8. The collar has a groove 9 in its inner surface defining a pair of arcuate, parallel ribs 10 and 11. The rib 10 preferably is radially thicker than the rib 11, for a purpose presently to be explained, but the ribs could be of the same radial thickness or the rib 11 could be thicker than the rib 10. The attachment 5 is formed from a material such as polypropylene, polyethylene, nylon, or the like, which has sufficient resiliency to enable the arms 7 and 8 to be moved toward and into engagement with one another and in substantially parallel overlying relation as is shown in FIG. 2. Such movement of the arms 7 and 8 results in radial contraction of the collar 6 and stressing of the latter so as to exert a constant force on the arms tending to return them to their diverging positions. This tendency is restrained and the arms are releasably maintained in overlying, substantially parallel relationship by separable latch means.

In the embodiment shown in FIGS. 1–4, the latch means comprises an integral finger or pawl 12 depending from the free end of the arm 7 and terminating in a lip 13. The arm 8 is provided with a slot or socket 14 between the side edges of the arm and of such width as snugly to accommodate the finger 12. At the base of the slot 14 is an undercut shoulder 15 on which the lip 13 is adapted to seat.

To apply the attachment 5 to the rotary knob 1, the arms 7 and 8 are spread apart, as shown in FIG. 1, and the collar 6 is fitted over the knob 1 to embrace the latter. The arms 7 and 8 then may be moved toward one another, thereby radially contracting the collar 6 to cause the latter tightly to grip the surface of the knob 1. The arms 7 and 8 are of sufficient flexibility to enable the latch lip 13 to snap under the shoulder 15 and maintain the attachment 5 assembled with the knob 1. The attachment may be removed from the knob 1 by disengaging the lip 13 from the shoulder 15.

When the attachment is applied to the knob 1, the attachment functions as a rockable lever to transmit rotation to the knob. The attachment may be applied to the knob with the arms extending horizontally, vertically, or at any angular position therebetween.

The knob 1 shown in FIG. 3 has a tapered configuration. Such a knob is in wide usage, thereby making it economical to produce attachments in large quantities for use with such knobs. When the attachment is applied to a tapered knob like that shown in FIG. 3, the radially thicker rib 10 will overlie the marginal edge of the face of the knob, to prevent movement of the collar 6 toward the door 3, and the radially thinner rib 11 will bear against the surface of the knob and prevent movement of the collar away from the door 3. The different thicknesses of the ribs thus function to position the collar axially of the axis of rotation of the knob.

If the rotary knob to which the attachment 5 is to be applied has a configuration other than that shown in FIG. 3, the attachment nevertheless may be used inasmuch as the resiliency of the material from which the collar 6 is formed will enable the latter to adapt to differently shaped surfaces. However, the cross-sectional configuration of the collar 6 can be molded in such manner as to complement knobs of many different configurations.

If the knob has no key slot therein, a decorative membrane (not shown) may overlie the face of the knob and be held in place by the rib 10. A decorative membrane also may be used if the knob has a key slot, but in this case the membrane also should have an opening in register with the key slot.

The attachment **5*a* shown in FIGS. 5 and 6 is similar to the previously described embodiment and includes a collar 6*a* and arms 7*a* and 8*a* having grooves 16 and 17, respectively, in their outer surfaces and grooves 18 and 19, respectively, at their free ends. Means for latching the arms 7*a* and 8*a* is overlying, substantially parallel positions comprises a U-shaped clip 20 having parallel legs 21 and 22 joined by a web 23 of such length as to span both legs. Serrations or teeth 24 are provided on the confronting surfaces of the legs 21 and 22** adjacent their free ends.

The clip 20 may be accommodated in the grooves 16–19 when the arms **7*a* and 8*a* are in overlying, engaged positions so as to maintain the collar 6*a*** in snugly embracing relationship with a rotary knob.

The attachment **5*b* shown in FIGS. 7–9 is similar to the earlier described embodiments and has a collar 6*b* from which extends a pair of arms 7*b* and 8*b*. Adjacent their junctures with the collar the arms 7*b* and 8*b* are relieved to form cavities 25 and 26, respectively, for the purpose of increasing the flexibility of the arms adjacent the collar. The latch means comprises a loop or ring 27 that is adapted to encircle the arms 7*b* and 8*b* and be retained in recesses or grooves 28 and 29 formed in the outer surfaces of the arms 7*b* and 8*b*** respectively.

The attachment **5*c*, shown in FIGS. 10–13, is similar to the earlier described embodiments and has a collar 6*c* from which extends a pair of arms 7*c* and 8*c***.

The latch means comprises a finger or pawl 31 depending from the free end of the arm **7*c* and having converging sides 32 which join with neck portions 33 that terminate in transverse shoulders 34 which extend on opposite sides of the neck portions 33. The shoulders terminate at their free ends in vertical edges 35 which merge with downwardly converging cam surfaces 36. The latch means also includes a socket 37 having downwardly converging sides 38 joined to vertical surfaces 39 which terminate in undercut keeper surfaces 40 that join with vertical surfaces 41 which, at their lower ends, merge with downwardly converging surfaces 42. The opposite sides of the socket 37 thus are complementary to the opposite sides of the pawl 31**.

Figure 11:
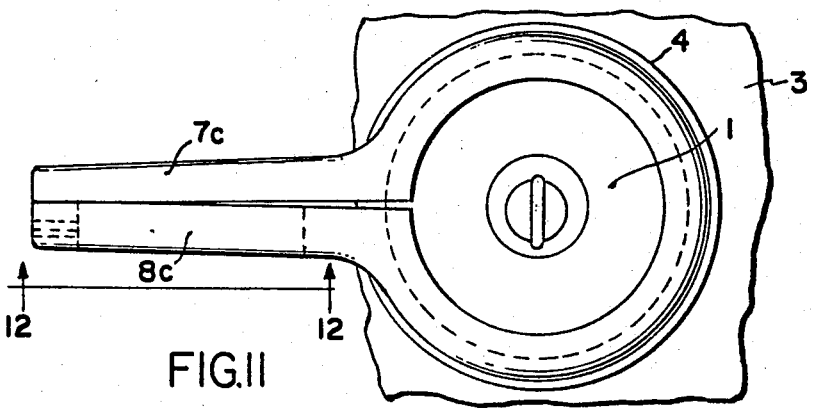
FIG. 11 is an elevated view illustrating the embodiment of FIG. 10 applied to a door knob.
Figure 12:
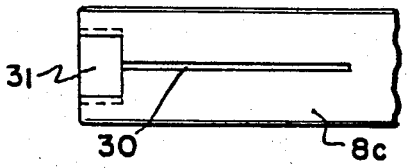
FIG. 12 is a fragmentary, bottom plan view taken on the line 12—12 of FIG. 11.
Figure 13:
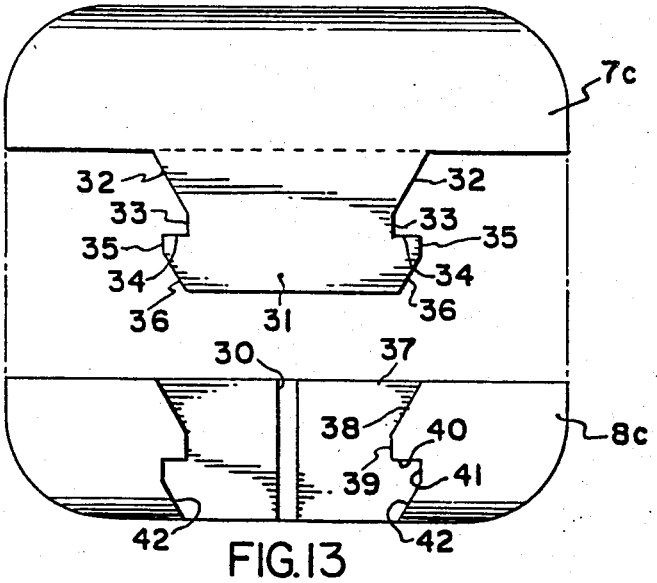
FIG. 13 is a greatly enlarged end elevational view from the left hand end of FIG. 11, but with the latch means unlatched.

The width of the pawl 31 from one vertical edge 35 to the other is greater than the distance between the vertical surfaces 39 of the socket 37. Thus, to fit the pawl 31 into the socket 37 the sides of the latter must be spread apart. Spreading apart of the sides of the socket is facilitated by the provision of an elongate slot 30 in the arm **8*c*. The slot communicates with the socket and extends longitudinally of the arm 8*c* toward the collar 6*c*, but terminates short of the latter. Thus, upon movement of the pawl 31 into the socket 37, the cam surfaces 36 of the pawl will bear against the downwardly converging surfaces 38 of the socket and cam the portions of the arm 8*c* on opposite sides of the slot 30 away from one another. When the pawl 31 is fully seated in the socket 37, the resilience of the material from which the arm 8*c* is made will enable the keeper portions 40 of the socket to overlie the shoulders 34 of the pawl and maintain the arms 7*c* and 8*c* in abutting, overlying relation as shown in FIG. 11**.

When it is desired to remove the attachment **5*c* from the door knob 1, the portions of the arm 8*c* on opposite sides of the slot 30 may be spread apart, thereby freeing the pawl 31 from the socket and enabling the arms 7*c* and 8*c*** to be separated from one another.

In all of the disclosed embodiments of the invention the latching means not only maintains the arms of the attachments in engagement with one another, but also prevents lateral movement of the arms relative to one another. The lever attachment, therefore, is extremely stable when it is applied to a rotary knob.

The disclosed embodiments are representative of presently preferred forms of the invention, but are intended to be illustrative rather than definitive thereof. The invention is defined in the claims.

I claim:

1. A lever attachment for a rotary knob comprising an arcuate collar having at its opposite ends arms of substantially equal length extending away from said collar and terminating in free ends, said collar being formed on an arc such that said collar may embrace said knob with said arms diverging from said collar, said collar being formed of material sufficiently resilient to enable said collar to be radially contracted and said arms to overlie and engage one another adjacent their free ends, and said collar having a groove in its inner surface flanked by a pair of parallel ribs; and latch means remote from said collar and releasably maintaining the free ends of said arms in engagement with each other, thereby maintaining said collar in radially contracted condition.

2. The attachment according to claim 1 wherein said latch means comprises a pawl carried by one of said arms and a socket in the other of said arms, said pawl being movable into and out of said socket.

3. The attachment according to claim 2 wherein said pawl and said socket are at the free ends of said arms.

4. The attachment according to claim 2 wherein said pawl and said socket have complementary cam surfaces engagable with one another in response to movement of said pawl into said socket.

5. The attachment according to claim 4 wherein said other of said arms has an elongate slot extending longitudinally of said other arm and communicating with said socket.

6. The attachment according to claim 1 wherein said latch means comprises a clip engaging both of said arms.

7. The attachment according to claim 6 wherein said clip is substantially U-shaped having a pair of legs joined at corresponding ends by a web.

8. The attachment according to claim 7 wherein the legs of said clip extend longitudinally of said arms and said web spans the free ends of said arms.

9. The attachment according to claim 7 wherein one leg of said clip engages one of said arms, the other leg of said clip engages the other of said arms, and the web of said clip spans said arms.

10. The attachment according to claim 7 wherein the legs of said clip are accommodated in recesses formed in said arms.

11. The attachment according to claim 1 wherein said latch means comprises a loop encircling said arms.

12. The attachment according to claim 11 wherein said loop is accommodated in recesses formed in said arms.

13. The attachment according to claim 1 wherein one of said ribs is radially thicker than the other.

14. The attachment according to claim 1 wherein said arms are relieved adjacent their juncture with said collar.

15. The attachment according to claim 1 wherein said latch means comprises a U-shaped clip having parallel legs joined at corresponding ends by a web, the other ends of said legs having confronting serrations.

* * * * *